US010214709B2

(12) United States Patent
Kim

(10) Patent No.: US 10,214,709 B2
(45) Date of Patent: Feb. 26, 2019

(54) OXYGEN-BASED CLEANING COMPOSITION COMPRISING A SAPONIN LAYER

(71) Applicant: Jeong Yup Kim, Seoul (KR)

(72) Inventor: Jeong Yup Kim, Seoul (KR)

( * ) Notice: Subject to any disclaimer, the term of this patent is extended or adjusted under 35 U.S.C. 154(b) by 68 days.

(21) Appl. No.: 15/535,062

(22) PCT Filed: Dec. 24, 2015

(86) PCT No.: PCT/KR2015/014254
§ 371 (c)(1),
(2) Date: Jun. 12, 2017

(87) PCT Pub. No.: WO2016/105158
PCT Pub. Date: Jun. 30, 2016

(65) Prior Publication Data

US 2018/0010076 A1 Jan. 11, 2018

(30) Foreign Application Priority Data

Dec. 24, 2014 (KR) ..... 10-2014-0188688

(51) Int. Cl.

| | |
|---|---|
| ***C11D 3/10*** | (2006.01) |
| ***C11D 3/386*** | (2006.01) |
| ***C11D 9/42*** | (2006.01) |
| ***C11D 3/39*** | (2006.01) |
| ***C11D 3/02*** | (2006.01) |
| ***C11D 17/06*** | (2006.01) |
| ***C11D 3/22*** | (2006.01) |
| ***C11D 17/00*** | (2006.01) |
| ***C11D 3/382*** | (2006.01) |
| ***C11D 11/00*** | (2006.01) |

(52) U.S. Cl.
CPC ..... *C11D 3/3942* (2013.01); *C11D 3/02* (2013.01); *C11D 3/221* (2013.01); *C11D 3/382* (2013.01); *C11D 3/38636* (2013.01); *C11D 11/0082* (2013.01); *C11D 17/0039* (2013.01); *C11D 17/06* (2013.01)

(58) Field of Classification Search
CPC ..... C11D 3/3942; C11D 3/02; C11D 17/06; C11D 3/221; C11D 3/38636; C11D 17/0039; C11D 3/382; C11D 11/0082; C11D 3/10; C11D 3/386; C11D 9/42
See application file for complete search history.

(56) References Cited

U.S. PATENT DOCUMENTS

| | | | | |
|---|---|---|---|---|
| 6,949,496 | B1 * | 9/2005 | Boutique | C11D 3/2024 510/276 |
| 2002/0086807 | A1 | 7/2002 | Lee et al. | |
| 2003/0191043 | A1 * | 10/2003 | Becker | C11D 3/0052 510/392 |
| 2006/0249707 | A1 | 11/2006 | Zimmermann et al. | |
| 2008/0274937 | A1 | 11/2008 | Venbrux et al. | |
| 2012/0276181 | A1 * | 11/2012 | Ibrahim | A01N 31/02 424/404 |
| 2015/0284664 | A1 * | 10/2015 | Preuschen | C11D 3/382 510/221 |
| 2017/0275563 | A1 * | 9/2017 | Federle | C11D 3/0052 |

FOREIGN PATENT DOCUMENTS

| | | | |
|---|---|---|---|
| JP | 2009-503156 | A | 1/2009 |
| JP | 5616188 | B2 | 10/2014 |
| KR | 10-2001-0097846 | A | 11/2001 |
| KR | 10-2006-0007425 | A | 1/2006 |
| KR | 10-2007-0005409 | A | 1/2007 |
| KR | 10-2008-0024115 | A | 3/2008 |
| KR | 10-1287127 | B1 | 7/2013 |

OTHER PUBLICATIONS

International Search Report for PCT/KR2015/014254 dated May 2, 2016 from Korean Intellectual Property Office.

* cited by examiner

*Primary Examiner* — Charles I Boyer
(74) *Attorney, Agent, or Firm* — Revolution IP, PLLC

(57) ABSTRACT

An oxygen-based cleaning composition, comprises a cleaning formulation in powder form, wherein the cleaning formulation includes a hydrogen peroxide addition compound layer comprising a hydrogen peroxide addition compound powder for producing hydrogen peroxide, a surfactant layer formed by coating an outer surface of the hydrogen peroxide addition compound layer with a liquid surfactant, and a saponin layer formed by coating an outer surface of the surfactant layer with a saponin powder.

9 Claims, 4 Drawing Sheets

[Fig. 1]
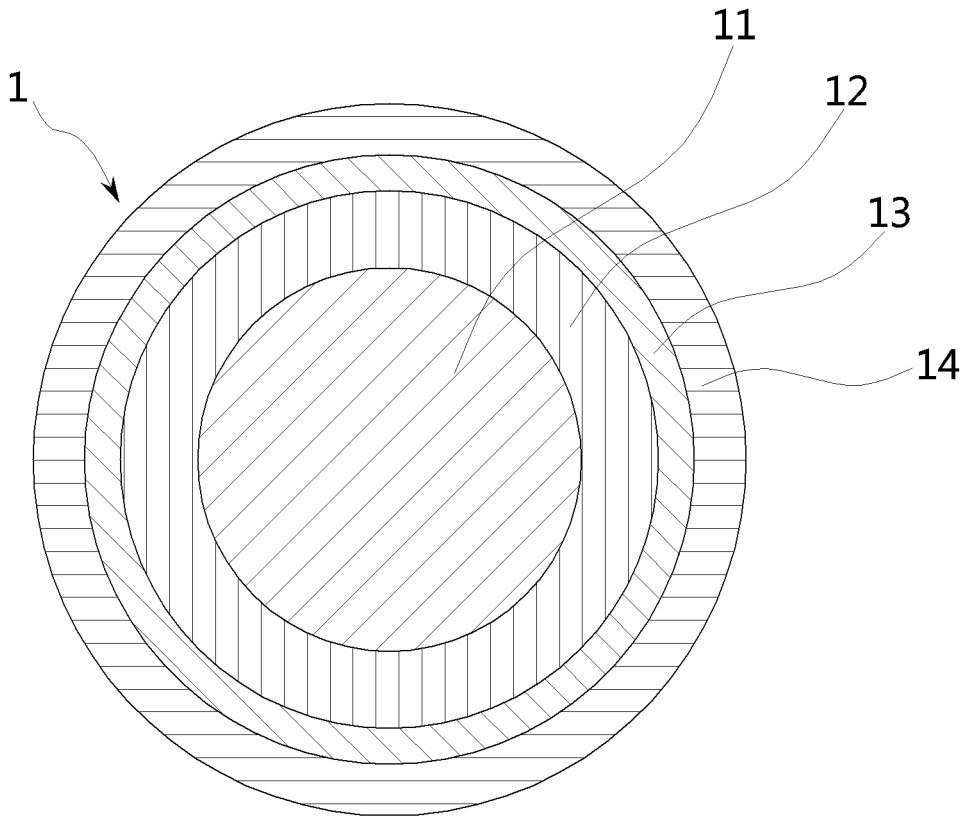

[Fig.2]
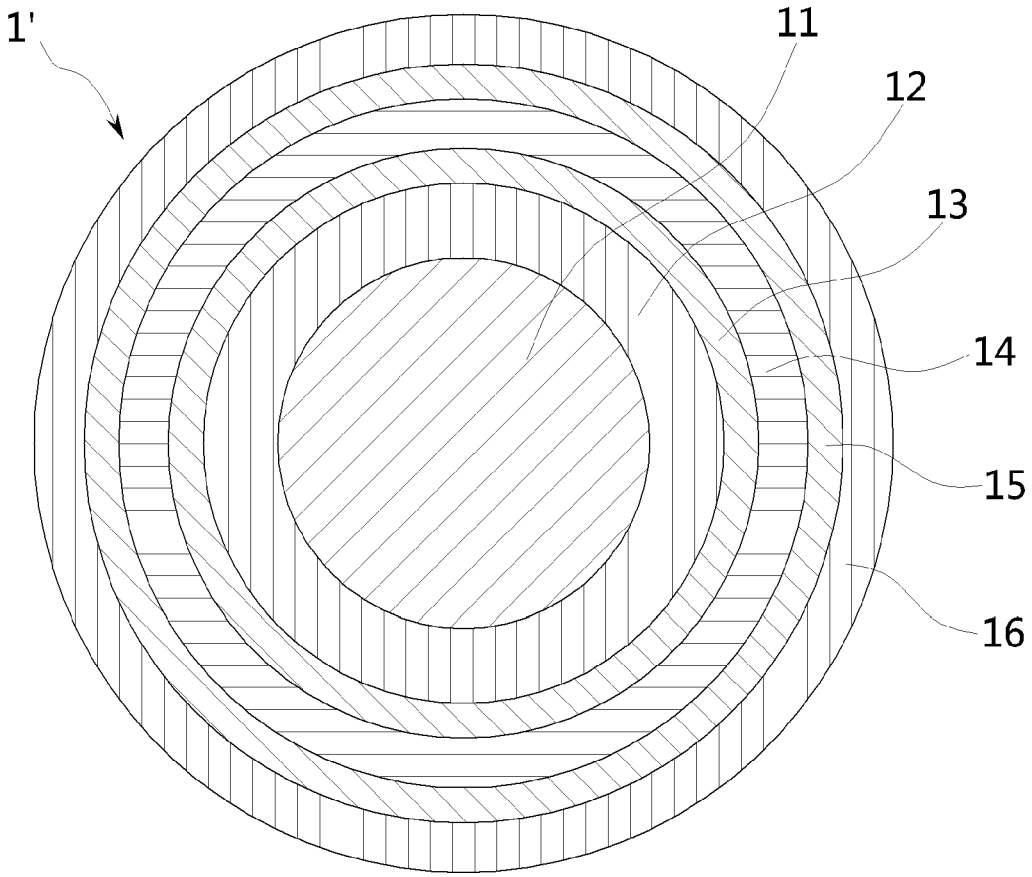

[Fig. 3]
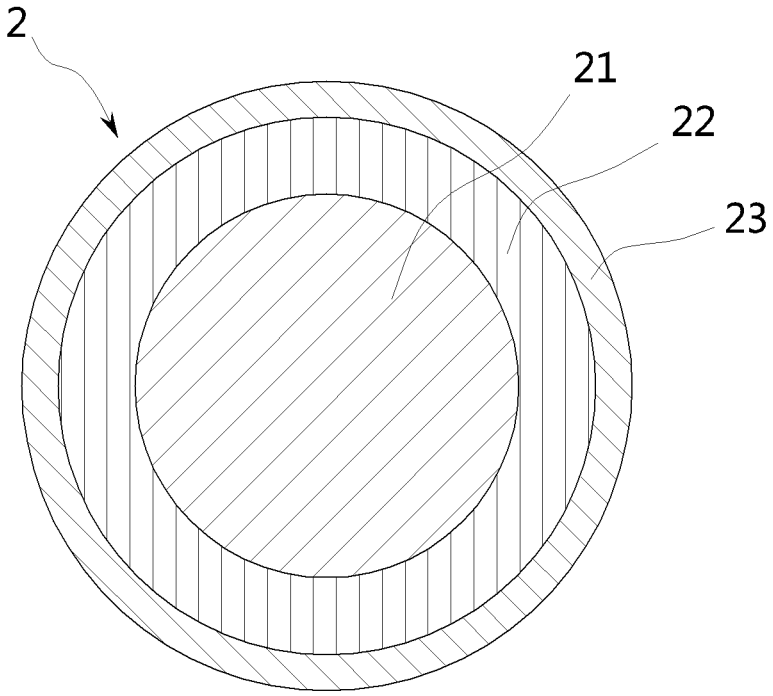

[Fig. 4]
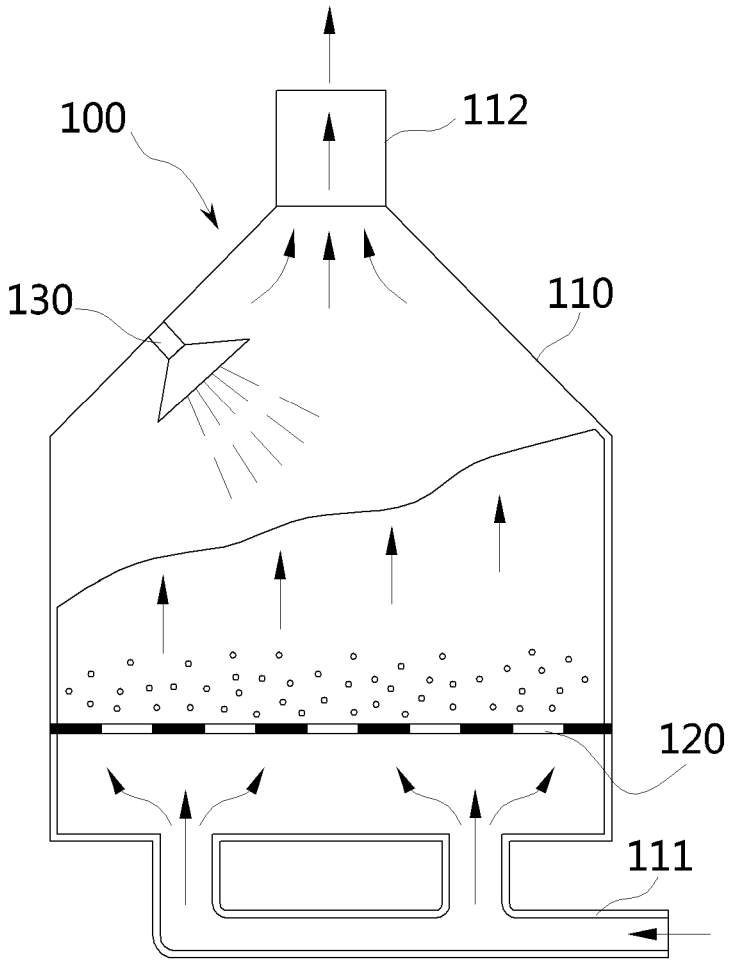

OXYGEN-BASED CLEANING COMPOSITION COMPRISING A SAPONIN LAYER

CROSS REFERENCE TO PRIOR APPLICATIONS

This application is a National Stage Application of PCT International Patent Application No. PCT/KR2015/014254 filed on Dec. 24, 2015, under 35 U.S.C. § 371, which claims priority to Korean Patent Application No. 10-2014-0188688 filed on Dec. 24, 2014, which are all hereby incorporated by reference in their entirety.

TECHNICAL FIELD

The present invention relates to an oxygen-based cleaning composition for use in washing clothes and cleaning bathroom products, kitchenware, and baby products, and more particularly to an oxygen-based cleaning composition, which includes a cleaning formulation configured to include a hydrogen peroxide addition compound layer comprising a hydrogen peroxide addition compound powder for producing hydrogen peroxide, a surfactant layer formed by coating the outer surface of the hydrogen peroxide addition compound layer with a liquid surfactant, and a saponin layer formed by coating the outer surface of the surfactant layer with a saponin powder, and is thus useful in a variety of products, is environmentally friendly and harmless to human bodies, and has improved cleaning and disinfecting effects.

BACKGROUND ART

A cleaner is a material that is dissolved in water so that impurities attached to the surface of a solid are washed out, and is referred to as a detergent, a bleaching agent, a washing agent, or a rinsing agent. Representative examples thereof are a chlorine-based cleaner and an oxygen-based cleaner. Here, the chlorine-based cleaner composed mainly of sodium hypochlorite exhibits strong cleaning power. However, the chlorine-based cleaner is problematic because discoloration and breakage of clothes may occur during cleaning, and moreover, chlorine gas is generated to thus cause discomfort to the user and be harmful to health. Hence, an oxygen-based bleaching agent using sodium percarbonate is receiving attention for home use, as disclosed in the following Patent Literature.

Patent Literature

Korean Patent No. 10-1287127 (Registration Date: 2013 Jul. 17.) "Oxygen bleach composition having improved solubility and bleaching ability"

However, since the conventional oxygen-based cleaner is focused on washing clothes and thus contains components harmful to human bodies, it cannot be used for cleaning various products, including bathroom products and kitchenware (toilets, sinks, etc.) due to the low cleaning power thereof, as well as goods (baby bottles, chopping boards, etc.) that come into contact with human food.

DISCLOSURE

Technical Problem

Accordingly, the present invention has been made keeping in mind the problems encountered in the related art and the present invention is intended to provide an oxygen-based cleaning composition, which may be used for washing clothes and cleaning various products, such as kitchenware, bathroom products and baby products.

In addition, the present invention is intended to provide an oxygen-based cleaning composition, which is composed of a material extracted from natural substances and is thus environmentally friendly and harmless to human bodies.

In addition, the present invention is intended to provide an oxygen-based cleaning composition, which is configured such that a surfactant layer, a saponin layer, and a sodium bicarbonate layer are sequentially formed on the outer surface of a hydrogen peroxide addition compound, thus generating a large amount of bubbles, increasing the oxygen generation time, improving cleaning and disinfecting effects, and exhibiting fiber-softening effects.

In addition, the present invention is intended to provide an oxygen-based cleaning composition, in which powdered solids (hydrogen peroxide addition compound, saponin, and sodium bicarbonate) are bound by a liquid surfactant, thus facilitating the preparation of a cleaning formulation having a multilayer structure.

In addition, the present invention is intended to provide an oxygen-based cleaning composition, which includes a cleaning formulation, the outermost layer of which is coated with sodium bicarbonate, thus exhibiting improved cleaning and foaming effects and preventing the outer surface thereof from being wet to thereby prevent cleaning formulations from sticking to each other, ultimately increasing ease of storage and shelf life.

Technical Solution

Therefore, the present invention is realized by the following embodiments.

An embodiment of the present invention provides an oxygen-based cleaning composition comprising a cleaning formulation in powder form, wherein the cleaning formulation includes a hydrogen peroxide addition compound layer comprising a hydrogen peroxide addition compound powder for producing hydrogen peroxide, a surfactant layer formed by coating the outer surface of the hydrogen peroxide addition compound layer with a liquid surfactant, and a saponin layer formed by coating the outer surface of the surfactant layer with a saponin powder.

In the oxygen-based cleaning composition according to the embodiment of the present invention, the cleaning formulation may further include a sodium bicarbonate layer formed by coating the outer surface of the saponin layer with a sodium bicarbonate powder.

In the oxygen-based cleaning composition according to the embodiment of the present invention, the cleaning formulation may comprise, based on 100 parts by weight of the hydrogen peroxide addition compound, 8 to 13 parts by weight of the surfactant, 0.5 to 2 parts by weight of saponin, and 4 to 8 parts by weight of sodium bicarbonate.

In the oxygen-based cleaning composition according to the embodiment of the present invention, the cleaning formulation may further include a binder layer applied on the outer surface of the sodium bicarbonate layer and a yeast layer applied on the outer surface of the binder layer.

In the oxygen-based cleaning composition according to the embodiment of the present invention, the saponin may be saponin extracted from soapberries.

In the oxygen-based cleaning composition according to the embodiment of the present invention, the hydrogen peroxide addition compound may be sodium percarbonate, and the binder layer may be formed by applying sorbitol on the outer surface of the sodium bicarbonate layer.

Another embodiment of the present invention provides a method of preparing an oxygen-based cleaning composition, comprising: a hydrogen peroxide addition compound layer and surfactant layer formation step of forming a hydrogen peroxide addition compound layer and a surfactant layer on the outer surface of the hydrogen peroxide addition compound layer by mixing and stirring a hydrogen peroxide addition compound powder and a liquid surfactant; a saponin layer formation step of forming a saponin layer on the outer surface of the surfactant layer by further mixing and stirring a saponin powder, after the hydrogen peroxide addition compound layer and surfactant layer formation step; and a sodium bicarbonate layer formation step of forming a sodium bicarbonate layer on the outer surface of the saponin layer by further mixing and stirring a sodium bicarbonate powder, after the saponin layer formation step.

Advantageous Effects

The present invention can exhibit the following effects via the above embodiments.

According to the present invention, an oxygen-based cleaning composition can be effectively used for washing clothes and cleaning various products, such as kitchenware, bathroom products and baby products.

In addition, the oxygen-based cleaning composition of the present invention, which is composed of a material extracted from natural substances, is environmentally friendly and harmless to human bodies.

In addition, the oxygen-based cleaning composition of the present invention, which is configured such that a surfactant layer, a saponin layer, and a sodium bicarbonate layer are sequentially formed on the outer surface of a hydrogen peroxide addition compound, is effective at generating a large amount of bubbles, increasing the oxygen generation time, improving cleaning and disinfecting effects, and exhibiting fiber-softening effects.

In addition, the oxygen-based cleaning composition of the present invention, which is configured such that powdered solids (hydrogen peroxide addition compound, saponin, and sodium bicarbonate) are bound by a liquid surfactant, is effective at facilitating the preparation of a cleaning formulation having a multilayer structure.

In addition, the oxygen-based cleaning composition of the present invention, which is configured such that the outermost layer of the cleaning formulation is coated with sodium bicarbonate, is effective at exhibiting improved cleaning and foaming effects and preventing the outer surface thereof from being wet to thereby prevent cleaning formulations from sticking to each other, ultimately increasing ease of storage and shelf life.

DESCRIPTION OF DRAWINGS

FIG. 1 is a cross-sectional view showing a cleaning formulation for use in an oxygen-based cleaning composition according to an embodiment of the present invention;

FIG. 2 is a cross-sectional view showing a cleaning formulation for use in an oxygen-based cleaning composition according to another embodiment of the present invention;

FIG. 3 is a cross-sectional view showing a catalase formulation for use in the oxygen-based cleaning composition according to the embodiment of the present invention; and FIG. 4 shows a fluidized-bed dryer used for the preparation of the catalase formulation of FIG. 3.

BEST MODE

Hereinafter, a detailed description will be given of an oxygen-based cleaning composition and a method of preparing the same according to the present invention, with reference to the appended drawings. Unless otherwise defined, all terms used herein have the same meaning as commonly understood by one of ordinary skill in the art to which the present invention belongs. If the meaning of the term used herein conflicts with the general meaning thereof, the definition used herein is to be accepted. As used herein, when any part "comprises" or "includes" any element, it means that other elements are not precluded but may be further included, unless otherwise mentioned.

As illustrated in FIGS. 1, 3 and 4, an oxygen-based cleaning composition according to an embodiment of the present invention includes a powder cleaning formulation 1, configured to contain a hydrogen peroxide addition compound, and a powder catalase formulation 2, configured to promote the dissolution of the hydrogen peroxide addition compound. Here, the catalase formulation is used in an amount of 0.5 to 4 parts by weight based on 100 parts by weight of the cleaning formulation.

The cleaning formulation 1 is in powder form, and includes a hydrogen peroxide addition compound layer 11, a surfactant layer 12 applied on the outer surface of the hydrogen peroxide addition compound layer 11, a saponin layer 13 applied on the outer surface of the surfactant layer 12, and a sodium bicarbonate layer 14 applied on the outer surface of the saponin layer 13. The cleaning formulation is preferably configured such that, based on 100 parts by weight of the hydrogen peroxide addition compound, 8 to 13 parts by weight of the surfactant, 0.5 to 2 parts by weight of saponin, and 4 to 8 parts by weight of sodium bicarbonate are used.

The hydrogen peroxide addition compound layer 11 is composed of a hydrogen peroxide addition compound powder able to produce hydrogen peroxide, and the hydrogen peroxide addition compound preferably includes sodium percarbonate or sodium perborate, and more preferably includes sodium percarbonate having high solubility at a low temperature.

The surfactant layer 12 is formed by coating the outer surface of the hydrogen peroxide addition compound layer 11 with a liquid surfactant, and the surfactant preferably includes a nonionic surfactant obtained from a natural substance, and more preferably includes an edible emulsifier obtained from coconut oil, palm oil, etc. In lieu of sodium fatty acid, which is widely used in cleaners (detergents), the edible emulsifier is used as the surfactant to thus reduce turbidity upon dissolution of the cleaning composition. The surfactant is preferably used in an amount of 8 to 13 parts by weight based on 100 parts by weight of the hydrogen peroxide addition compound. If the amount of the surfactant is less than 8 parts by weight, it is not easy to form the saponin layer. On the other hand, if the amount thereof exceeds 13 parts by weight, it is not easy to produce a cleaning formulation in a solid phase.

The saponin layer 13 is formed by coating the outer surface of the surfactant layer 12 with a saponin powder, and the saponin is preferably extracted from soapberries. Saponin functions to impart the cleaner with improved cleaning, antibacterial, fiber-softening and bubbling effects. The saponin is preferably used in an amount of 0.5 to 2 parts by weight based on 100 parts by weight of the hydrogen peroxide addition compound. If the amount of saponin is less than 0.5 parts by weight, cleaning, antibacterial, fiber-softening and bubbling effects may decrease. On the other hand, if the amount thereof exceeds 2 parts by weight, economic benefits may be negated and cleaning effects may deteriorate.

The sodium bicarbonate layer 14 is formed by coating the outer surface of the saponin layer 13 with a sodium bicarbonate powder, and the sodium bicarbonate functions to increase the cleaning and foaming capabilities of the cleaner. Also, sodium bicarbonate plays a role in drying the cleaning formulation to thus increase ease of storage and shelf life. Here, sodium bicarbonate is preferably used in an amount of 4 to 8 parts by weight based on 100 parts by weight of the hydrogen peroxide addition compound. If the amount of sodium bicarbonate is less than 4 parts by weight, the cleaning formulations may stick to each other due to a liquid surfactant. On the other hand, if the amount of sodium bicarbonate exceeds 8 parts by weight, cleaning power may decrease.

A method of preparing the above cleaning formulation includes a hydrogen peroxide addition compound layer and surfactant layer formation step, a saponin layer formation step, and a sodium bicarbonate layer formation step. In the method of preparing the cleaning formulation, a typically useful industrial mixer (stirrer) is adopted to mix various materials.

In the hydrogen peroxide addition compound layer and surfactant layer formation step, a hydrogen peroxide addition compound powder and a liquid surfactant are mixed and stirred using an industrial mixer, thereby forming a hydrogen peroxide addition compound layer 11 and a surfactant layer 12 on the outer surface of the hydrogen peroxide addition compound layer. The surfactant is used in an amount of 8 to 13 parts by weight based on 100 parts by weight of the hydrogen peroxide addition compound. The surfactant is in a liquid phase, and the outer surface of the hydrogen peroxide addition compound may be easily coated with the surfactant.

In the saponin layer formation step that follows the hydrogen peroxide addition compound layer and surfactant layer formation step, a saponin powder is further placed in the industrial mixer and stirred, thereby forming a saponin layer 13 on the outer surface of the surfactant layer. Here, saponin is used in an amount of 0.5 to 2 parts by weight based on 100 parts by weight of the hydrogen peroxide addition compound. The surfactant layer is in a sticky liquid state, and thus the outer surface of the surfactant layer is easily coated with saponin.

In the sodium bicarbonate layer formation step that follows the saponin layer formation step, a sodium bicarbonate powder is further placed in the industrial mixer and stirred, thereby forming a sodium bicarbonate layer 14 on the outer surface of the saponin layer. Here, sodium bicarbonate is used in an amount of 4 to 8 parts by weight based on 100 parts by weight of the hydrogen peroxide addition compound. Although the saponin layer is formed on the outer surface of the surfactant layer, a portion of the saponin layer is wet by the surfactant, and thus the outer surface of the saponin layer may be easily coated with sodium bicarbonate through mixing and stirring of sodium bicarbonate. The cleaning formulation is configured not to include the hydrogen peroxide addition compound alone but to form the surfactant layer, the saponin layer, and the sodium bicarbonate layer on the outer surface of the hydrogen peroxide addition compound, thus generating a large amount of bubbles and providing a multilayer structure on the outer surface of the hydrogen peroxide addition compound such that the generation of oxygen lasts for at least a predetermined period of time rather than occurring all at once. Moreover, cleaning and disinfecting effects may be increased and fiber-softening effects may be caused by saponin, and the cleaning formulation is made of natural substances and is thus environmentally friendly. Furthermore, powdered solids may be easily bound by the liquid surfactant, and the cleaning formulation has improved cleaning and foaming effects due to the use of sodium bicarbonate, and moreover, its outer surface is prevented from being wet and sticking to another cleaning formulation, ultimately increasing ease of storage and shelf life.

A cleaning formulation according to another embodiment of the present invention is described with reference to FIG. 2. The cleaning formulation 1' further includes a binder layer 15 applied on the outer surface of the sodium bicarbonate layer 14 and a yeast layer 16 applied on the outer surface of the binder layer 15, unlike the cleaning formulation of FIG. 1. The binder layer 15 functions to attach yeast to the outer surface of the sodium bicarbonate layer 14, and examples thereof may include polyethylene glycol, fructose, sorbitol, etc. The yeast layer 16 is formed by coating the outer surface of the binder layer 15 with yeast. The yeast reacts via the action of catalase to thus exhibit cleaning effects.

The catalase formulation 2 is configured to promote the dissolution of the hydrogen peroxide addition compound, and the catalase formulation is used in an amount of 0.5 to 4 parts by weight based on 100 parts by weight of the cleaning formulation. In the case where catalase is used as the enzyme in the cleaning composition, the catalase itself is liquid and may thus react with the other components (cleaning formulation) of the cleaning composition, undesirably deteriorating the stability of the cleaning composition. Hence, catalase is powdered to thus form a catalase formulation so as to improve the stability of the cleaning composition. The catalase formulation 2 includes a seed material 21, a liquid catalase 22 applied and dried on the seed material, and a coating layer 23 formed around the outer surface of the catalase 22.

The seed material 21 functions to support the liquid catalase, and includes, for example, any one or more selected from among sugar spheres, polyethylene glycol (PEG 4,000 to 6,000), sodium sulfate, salt, sodium citrate, and phosphate.

The catalase 22 is in a liquid phase, and is applied and dried on the seed material 21, and the catalase is an enzyme present in peroxisome of almost all aerobic cells and is distributed in some organs of the human body and also exists in the cells of animals and plants. The catalase is a tetramer comprising four polypeptide chains, each chain being composed of 500 or more amino acids. The catalase has four porphyrin heme groups and is known to be a catalyst for decomposing hydrogen peroxide through reaction with hydrogen peroxide. The reaction rate of catalase is very high, 1 mol catalase being known to decompose 500 million hydrogen peroxide molecules within 1 min. In the above cleaning composition, the catalase is responsible for promoting the dissolution of sodium percarbonate in water at 15° C. to 25° C.

The coating layer 23 is formed by coating the outer surface of the catalase 22 with trehalose, and functions to prevent the outer surface of the catalase formulation from being wet so that the catalase and the cleaning formulation do not stick to each other, thus increasing ease of storage and shelf life.

A method of preparing the above catalase formulation includes a quantification step, a coating and drying step, and a coating layer formation step. A fluidized-bed dryer used for the preparation of the catalase formulation is briefly described. The fluidized-bed dryer 100 includes a housing 110, which forms the outer shape of the fluidized-bed dryer and includes a port (not shown) that enables the supply and discharge of the seed material and an inlet 111 and an outlet 112 that enable the inflow and outflow of heated air; a perforated plate 120 located in the housing 110 and configured to support the seed material; and a nozzle 130 for spraying liquid catalase or liquid trehalose onto the seed material.

In the quantification step, a predetermined amount of seed material is located in the fluidized-bed dryer 100 through the port. In the coating and drying step that follows the quantification step, liquid catalase is sprayed onto the seed material via the nozzle 130 and heated air having a predetermined pressure and temperature is jetted via the inlet 111 and discharged via the outlet 112, whereby the outer surface of the fluidized seed material is coated with the catalase. In the coating and drying step, the catalase is used in an amount of 250 to 350 ml based on 1 kg of the seed material, and the pressure for jetting heated air is 1 to 2.5 Kg/m$^2$ and the temperature for jetting heated air is 55 to 69° C., so that the air outlet temperature (internal temperature of the housing) is less than 50° C., and the catalase is added at a rate of 1.5 to 3 ml/min. In the coating layer formation step that follows the coating and drying step, a trehalose solution is sprayed onto the seed material coated with catalase via the nozzle 130 and heated air having a predetermined pressure and temperature is jetted via the inlet 111 and discharged via the outlet 112, whereby the solid coating layer is formed on the outer surface of the catalase. In the coating layer formation step, the trehalose solution (10% concentration) is used in an amount of 150 to 250 ml based on 1 kg of the seed material, and the pressure for jetting heated air is 1 to 2.5 Kg/m$^2$ and the temperature for jetting heated air is 55 to 69° C., so that the air outlet temperature (internal temperature of the housing) is less than 50° C., and the trehalose solution is added at a rate of 1.5 to 3 ml/min. The method of preparing the catalase formulation is performed under conditions of the pressure and temperature for jetting heated air and the rate of addition of catalase set forth above, thus easily obtaining granulated catalase without losing the activity of the catalase.

A better understanding of the present invention is given through the following Examples, which are merely set forth to illustrate but are not to be construed as limiting the scope of the present invention.

EXAMPLE 1

1) Preparation of Cleaning Formulation 870 g of sodium percarbonate and 70 g of a surfactant (edible emulsifier Tween 20) were placed in an industrial mixer and stirred, and then 10 g of a saponin powder was further placed in the industrial mixer and stirred, after which 50 g of sodium bicarbonate was further placed in the industrial mixer and stirred, thus obtaining a cleaning formulation.

2) Preparation of Catalase Formulation 1 kg of sugar spheres was placed in a fluidized-bed dryer, catalase was sprayed at a rate of 2 ml/min for 2 hr 30 min via a nozzle, and heated air (jetting pressure: 2.0 Kg/m$^2$, jetting temperature: 61° C., internal temperature of housing: 47° C.) was supplied into the fluidized-bed dryer, after which a trehalose solution (10% concentration) was sprayed at a rate of 2 ml/min for 1 hr 40 min via the nozzle and heated air (jetting pressure: 2.0 Kg/m$^2$, jetting temperature: 61° C., internal temperature of housing: 47° C.) was supplied into the fluidized-bed dryer, thus obtaining a catalase formulation.

3) Preparation of Oxygen-Based Cleaning Composition

An oxygen-based cleaning composition was prepared by mixing 1 kg of the cleaning formulation and 10 g of the catalase formulation.

EXAMPLE 2

An oxygen-based cleaning composition was prepared under the same conditions as in Example 1, with the exception that a cleaning formulation was obtained in a manner in which 700 g of sodium percarbonate and 60 g of a surfactant (edible emulsifier Tween 20) were placed in an industrial mixer and stirred, 10 g of a saponin powder was then further placed in the industrial mixer and stirred, 50 g of sodium bicarbonate was then further placed in the industrial mixer and stirred, 20 g of sorbitol was then further placed in the industrial mixer and stirred, and 160 g of yeast was then further placed in the industrial mixer and stirred.

COMPARATIVE EXAMPLES 1 TO 3

1) The oxygen-based cleaning composition of Comparative Example 1 was prepared under the same conditions as in Example 1, with the exception that 1000 g of sodium percarbonate was used as the cleaning formulation.

2) The oxygen-based cleaning composition of Comparative Example 2 was prepared under the same conditions as in Example 1, with the exception that a cleaning formulation was obtained by placing 900 g of sodium percarbonate and 100 g of a surfactant (edible emulsifier Tween 20) in an industrial mixer and stirring them.

3) The oxygen-based cleaning composition of Comparative Example 3 was prepared under the same conditions as in Example 1, with the exception that a cleaning formulation was obtained in a manner in which 890 g of sodium percarbonate and 90 g of a surfactant (edible emulsifier Tween 20) were placed in an industrial mixer and stirred, and 20 g of a saponin powder was then further placed in the industrial mixer and stirred.

TEST EXAMPLE 1

Evaluation of Cleaning Power (Bleaching Power) for Clothes

1) The oxygen-based cleaning composition of each of the Examples and Comparative Examples was dissolved in water (3.3 g of the cleaning solution based on 1 L of water) and then evaluated for cleaning power (bleaching power) for clothes. The results are shown in Table 1 below. The washing machine was a Terg-O-Termeter, and the whiteness meter, used to measure changes in light reflectance for each piece of soiled fabric in order to evaluate the bleaching power, was a Color Guard 2000. The bleaching test was performed in accordance with KS M2175 (Synthetic detergent test method for clothes). In the Terg-O-Termeter, 15 sheets of each of uniformly soiled fabric 1, coffee-soiled cotton (CFC/code: BC-2), and soiled fabric 2, coffee-soiled cotton (CFC/code: BC-3), were placed and stirred for 10 min, and the degrees of whiteness before and after stirring were compared and bleaching power was measured.

2) Examples 1 and 2 were superior in bleaching power compared to Comparative Examples 1 to 3. The bleaching power was higher in Comparative Example 3 than in Comparative Example 1 and was greater in Example 1 than in Comparative Example 3, from which the bleaching power can be found to be excellent when using the cleaning formulation by coating the outer surface of sodium persulfate with saponin and sodium bicarbonate, compared to when using sodium persulfate alone.

TABLE 1

| | Ex. 1 | Ex. 2 | C. Ex. 1 | C. Ex. 2 | C. Ex. 3 |
|---|---|---|---|---|---|
| Bleaching power (%) | 89.22 | 84.33 | 68.32 | 61.45 | 77.82 |

TEST EXAMPLE 2

Evaluation of Cleaning Power for Baby Products and Bathroom Products 1) 3 g of a contaminant (comprising milk and soy oil mixed at a ratio of 1:1) was applied on the inner surface of a baby bottle, the baby bottle was 70% filled with water, and 5 g of the oxygen-based cleaning composition of each of the Examples and Comparative Examples was placed in the baby bottle and allowed to stand for 10 min, after which the baby bottle was washed with water and the degree of contamination of the baby bottle was evaluated with the naked eye. The results are shown in Table 2 below. The evaluation criteria are as follows: 5: excellent, 4: good, 3: fair, 2: poor, 1: very poor.

2) In a toilet covered with scale and impurities due to use by 5 persons for 10 days, 90 g of the oxygen-based cleaning composition of each of the Examples and Comparative Examples was placed and allowed to stand for 20 min, the toilet was washed with water, and the degree of contamination of the toilet was evaluated with the naked eye. The results are shown in Table 2 below. The evaluation criteria are as follows: 5: excellent, 4: good, 3: fair, 2: poor, 1: very poor.

3) Examples 1 and 2 were superior in cleaning power compared to Comparative Examples 1 to 3. These results approximately match the results of Test Example 1.

TABLE 2

| | Before use of cleaning composition | Ex. 1 | Ex. 2 | C. Ex. 1 | C. Ex. 2 | C. Ex. 3 |
|---|---|---|---|---|---|---|
| Cleaning power (baby bottle) | 1 | 5 | 5 | 3 | 3 | 4 |
| Cleaning power (toilet) | 1 | 4 | 4 | 3 | 2 | 3 |

TEST EXAMPLE 3

Evaluation of Disinfecting Effect

1) A sink filter, a toilet, a toy, a washing bath, a baby bottle and sports shoes were mixed with water and a predetermined amount of the oxygen-based cleaning composition of each of the Examples and Comparative Examples, and the number of bacteria before and after the use of the oxygen-based cleaning composition was measured using a simple bacterial counter (ATP TEST). The results are shown in Table 3 below.

2) Examples 1 and 2 were superior in disinfecting effects compared to Comparative Examples 1 to 3. Also, Comparative Example 2 was relatively poor in disinfecting effect, which appears to indicate that the cleaning formulations of Comparative Example 2 were entangled and did not dissolve well.

TABLE 3

| | Before use | Ex. 1 | Ex. 2 | C. Ex. 1 | C. Ex. 2 | C. Ex. 3 |
|---|---|---|---|---|---|---|
| Sink filter | 62624 | 13 | 19 | 50 | 100 | 33 |
| Toilet | 94018 | 141 | 199 | 234 | 367 | 202 |
| Toy | 2376 | 184 | 176 | 178 | 230 | 183 |
| Washing bath | 1400 | 167 | 145 | 199 | 231 | 168 |
| Baby bottle | 137 | 3 | 2 | 5 | 10 | 4 |
| Sports shoes | 21475 | 141 | 166 | 200 | 243 | 156 |

TEST EXAMPLE 4

Effects of Bubbling and Continuous Oxygen Generation

1) A beaker containing 500 ml of water was added with 5 g of the oxygen-based cleaning composition of each of the Examples and Comparative Examples, and the state thereof was observed with the naked eye for 30 min. The results of bubbling and continuous oxygen generation (upon observation of bubbling, oxygen was evaluated to be continuously generated) are shown in Table 4 below. The evaluation criteria are as follows: 5: excellent, 4: good, 3: fair, 2: poor, 1: very poor.

2) Examples 1 and 2 were superior in bubbling and in the duration of continuous oxygen generation compared to Comparative Examples 1 to 3. Not only Comparative Example 2 but also Comparative Example 1 exhibited deteriorated effects. In Comparative Example 1, not many bubbles were formed due to the use of sodium percarbonate alone, and the oxygen generated from sodium percarbonate was mostly removed due to the absence of bubbles.

TABLE 4

| | Ex. 1 | Ex. 2 | C. Ex. 1 | C. Ex. 2 | C. Ex. 3 |
|---|---|---|---|---|---|
| Bubbling | 5 | 5 | 3 | 2 | 4 |
| Continuous oxygen generation | 5 | 5 | 3 | 2 | 4 |

TEST EXAMPLE 5

Fiber-Softening Effect

1) In a washing machine, a towel made of cotton, water and the oxygen-based cleaning composition of each of the Examples and Comparative Examples (used in an amount of 3.3 g based on 1 L of water) were placed, washed in a standard washing mode, and dried, and the tactile effect (fiber-softening effect) on the towel was evaluated. The results are shown in Table 5 below. The evaluation criteria are as follows: 5: excellent, 4: good, 3: fair, 2: poor, 1: very poor.

2) Examples 1 and 2 and Comparative Example 3 exhibited superior fiber-softening effects. This is deemed to be due to the use of saponin.

TABLE 5

| | Ex. 1 | Ex. 2 | C. Ex. 1 | C. Ex. 2 | C. Ex. 3 |
|---|---|---|---|---|---|
| Fiber-softening effect | 5 | 5 | 3 | 3 | 5 |

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An oxygen-based cleaning composition, comprising a cleaning formulation in powder form, wherein the cleaning formulation includes;

a) a layer comprising a hydrogen peroxide addition compound powder for producing hydrogen peroxide;

b) a surfactant layer formed by coating an outer surface of the hydrogen peroxide addition compound layer with a liquid surfactant;

c) a saponin layer formed by coating an outer surface of the surfactant layer with a saponin powder; and d) a sodium bicarbonate layer formed by coating an outer surface of the saponin layer with a sodium bicarbonate powder, wherein the cleaning formulation comprises, based on 100 parts by weight of the hydrogen peroxide addition compound, 8 to 13 parts by weight of the surfactant, 0.5 to 2 parts by weight of saponin, and 4 to 8 parts by weight of sodium bicarbonate.

2. The oxygen-based cleaning composition of claim 1, wherein the cleaning formulation further includes a binder layer applied on an outer surface of the sodium bicarbonate layer and a yeast layer applied on an outer surface of the binder layer.

3. The oxygen-based cleaning composition of claim 1, wherein the saponin is saponin extracted from soapberries.

4. The oxygen-based cleaning composition of claim 2, wherein the hydrogen peroxide addition compound is sodium percarbonate, and the binder layer is formed by applying sorbitol on an outer surface of the sodium bicarbonate layer.

5. The oxygen-based cleaning composition of claim 1, further comprising a catalase formulation for promoting dissolution of the hydrogen peroxide addition compound, wherein the catalase formulation includes a seed material for supporting a liquid catalase, the liquid catalase applied and dried on the seed material, and a coating layer formed on an outer surface of the catalase.

6. A method of preparing the oxygen-based cleaning composition of claim 1, comprising the steps of:

a) forming a hydrogen peroxide addition compound layer and a surfactant layer on an outer surface of the hydrogen peroxide addition compound layer by mixing and stirring a hydrogen peroxide addition compound powder and a liquid surfactant;

b) forming a saponin layer on an outer surface of the surfactant layer by further mixing and stirring a saponin powder; and c) forming a sodium bicarbonate layer on an outer surface of the saponin layer by further mixing and stirring a sodium bicarbonate powder.

7. The method of claim 6, further comprising preparing a catalase formulation for promoting dissolution of the hydrogen peroxide addition compound using a fluidized-bed dryer, the preparing the catalase formulation comprising:

a coating and drying step of coating an outer surface of a fluidized seed material with catalase by spraying a liquid catalase onto a seed material and supplying heated air having a predetermined pressure and temperature; and a coating layer formation step of forming a solid coating layer on an outer surface of the catalase by spraying a coating solution onto the seed material coated with the catalase and supplying heated air having a predetermined pressure and temperature, after the coating and drying step.

8. The method of claim 7, wherein, in the coating and drying step, the catalase is used in an amount of 250 to 350 ml based on 1 kg of the seed material, the pressure for jetting the heated air is 1 to 2.5 $Kg/m^2$, the temperature for jetting the heated air is 55 to 69° C., and the catalase is added at a rate of 1.5 to 3 ml/min.

9. The method of claim 8, wherein the fluidized-bed dryer comprises:

a housing, which forms an outer shape of the fluidized-bed dryer and includes a port that enables supply and discharge of the seed material and an inlet and an outlet that enable inflow and outflow of the heated air;

a perforated plate located in the housing and configured to support the seed material; and a nozzle located in the housing and configured to spray liquid catalase or liquid trehalose onto the seed material.

* * * * *